United States Patent [19]

de Brock

[11] Patent Number: 4,665,819

[45] Date of Patent: May 19, 1987

[54] DEVICE FOR APPLYING SURFACE PRESSURE TO AN ADVANCING WORKPIECE

[75] Inventor: Raoul de Brock, Kortrijk, Belgium

[73] Assignee: Firma Theodor Hymmen, Bielefeld, Fed. Rep. of Germany

[21] Appl. No.: 731,477

[22] Filed: May 7, 1985

[30] Foreign Application Priority Data

May 10, 1984 [DE] Fed. Rep. of Germany ..... 3417288

[51] Int. Cl.[4] ..... B30B 5/04

[52] U.S. Cl. ..... 100/154; 277/34

[58] Field of Search ..... 100/151, 152, 153, 154, 100/93 RP, 93 P; 156/555, 583.5; 425/371; 277/34, 34.3, 34.6, 227, 22, 27, 200, DIG. 7

[56] References Cited

U.S. PATENT DOCUMENTS 2,303,090 11/1942 Pranger et al: ..... 277/34 X 3,748,225 7/1973 Busker et al. ..... 100/154 X 4,331,073 5/1982 Girola ..... 100/154

4,555,988 12/1985 Pankoke ..... 100/154

FOREIGN PATENT DOCUMENTS 365104 7/1930 United Kingdom ..... 277/34.3

*Primary Examiner*—Peter Feldman

*Attorney, Agent, or Firm*—Michael J. Striker

[57] ABSTRACT

A device for applying surface pressure to a movable workpiece, for example a plate of wood, comprises two pressure-applying endless belts on which pressure is exerted by means of pressure air contained in two pressure chambers. Each pressure chamber is defined by a back side of the belt, a pressure plate and a sealing provided on the pressure plate. The sealing includes longitudinal wave-shaped sealing strips extended along the longitudinal edges of the pressure plate and transversal strips.

13 Claims, 6 Drawing Figures

DEVICE FOR APPLYING SURFACE PRESSURE TO AN ADVANCING WORKPIECE

BACKGROUND OF THE INVENTION

The present invention relates to a device for applying surface pressure to a moving workpiece, for example wooden plate or the like, to which surface pressure, for example for connecting thereto of a sheet of foil, is applied by means of endless pressing belts, the operating strands of which press against the outer surfaces of the workpiece being treated.

In conventional surface pressure applying devices of the foregoing type the pressing belts are pressed against the surfaces of the workpiece by means of pressure medium admitted into pressure chambers provided in the device; these pressure chambers are normally each enclosed by the operating strand of the pressing belt, a rectangular pressure plate and a sealing supported against the pressing belt and provided on the peripheral edge of the pressure plate.

The device of the type under discussion is disclosed in EP No. 0,026,396. The straight-line sealing strips extending over the longitudinal and transversal edges of the pressure plate form one sealing, and a rectangular seal forms a sealing on the pressure plate.

If a lubrication agent is to be supplied to each pressing belt and to those sealing strips which form a seal in the transversal direction of the device, are intensively supplied with the lubrication agent whereas the lubrication of the seal in the region of the outlet of the pressing belt is insufficient. The straight-line sealing strips forming the seal in the longitudinal direction contain the lubrication agent only in the region of the inlet of the pressing belt while their remaining portions can dry out.

SUMMARY OF THE INVENTION

It is an object of the present invention to provide an improved device for applying surface pressure to an advancing workpiece.

It is another object of this invention to provide a surface pressure-applying device in which a uniform lubrication agent supply and a distribution at all sealing strips of the seals would be ensured.

These and other objects of the invention are attained by a device for applying surface pressure to a workpiece being treated upon an advancement thereof through the device, comprising at least one endless pressing belt having a working strand which is pressed against the workpiece by means of a pressure medium; at least one pressure chamber containing the pressure medium; at least one substantially rectangular pressure plate having longitudinal and transversed edges; and at least one sealing provided at the edges of said pressure plate and being supported against said pressing belt, said pressure chamber being defined by said working strand at a side thereof facing away from the workpiece, said pressure plate and said sealing, said sealing including longitudinal sealing strips extending in the longitudinal direction and transversal sealing strips extending in the transversal direction of said pressure plate, said longitudinal sealing strips being shaped and defining shaped portions of said pressure chamber, and wherein a lubrication agent is admitted into the pressure chamber adjacent to the transversal sealing strips.

The admission of the lubrication agent may be obtained by means arranged inside the shaped portions of the chamber or outside the pressure chamber in the region of the transversal sealing strips.

The bulging portions of the pressure chamber may be distributed over the entire length thereof.

The longitudinal sealing strips may be provided at the longitudinal edges of the pressure plate and may be wave-shaped or zig-zag-shaped.

The bulging portions of the pressure chamber may be rectangular or circular.

The device may further include at least one supporting member for supporting said sealing strips, the transversal sealing strips extending substantially over the entire width of said supporting member.

The device may further comprise at least one diaphragm connected to said supporting member, said diaphragm having edges which are fluid-tight and gas-tight connected to the pressure plate, said diaphragm with said pressure plate forming a chamber for admitting a pressure medium and a lubrication agent, said supporting member being provided with nozzles loaded with the pressure medium and the lubrication agent.

The device may also include fastening bolts for securing the supporting member to the diaphragm, said nozzles being arranged in said fastening bolts.

Pressure air admixed with oil particles may be used to built up pressure in the pressure chamber.

The transversal sealing strips may be wave-shaped or zig-zag-shaped.

The device may further comprise means for feeding the lubrication agent,assigned to one of the transversal sealing strips outside said chamber and to another of said transversal sealing strips inside said pressure chamber.

Due to the shaped sealing strips it is always ensured that the lubrication agent fed to each pressing belt is transferred to the region of the sealing strips and is uniformly distributed via the sealing surfaces. Thereby service life of the sliding seal is substantially prolonged.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 3:
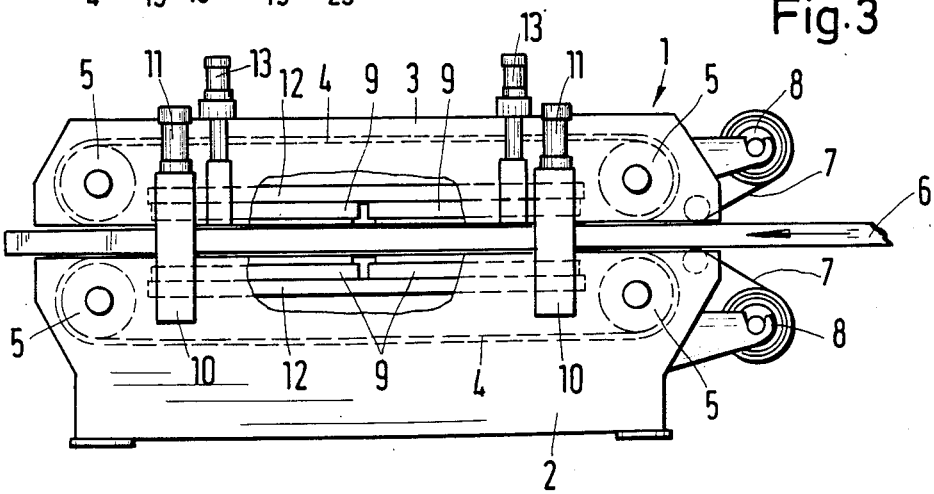
FIG. 3 is a side view of the surface pressure applying device of the present invention.

Referring now to the drawings in detail, the device for applying contact pressure to a moving workpiece is shown in FIG. 3 and is designated by reference numeral 1. The device 1 of this invention comprises a lower frame 2 and an upper frome 3 in which respective endless pressing belts 4 are accommodated. Each pressing belt runs about two rotary deflection rollers 5 and is thereby driven by these rollers. Two pressing belts 4 are spaced from each other by a gap, the width of which corresponds to the width of a workpiece 6 being treated while a horizontal movement is imparted to workpiece 6 by any conventional suitable means as shown by the arrow in FIG. 3. The running pressing belts 4 come into contact with two opposite outer surfaces of the workpiece so that the latter is pulled into the gap and becomes there loaded with pressure of the working strands of the belts. Upon advancing of workpiece 6 through the device 1 the workpiece is treated so that a finished product leaves the gap between the pressing belts 4.

In the exemplified embodiment the upper and lower surfaces of the workpiece 6 are covered with a film or foil 7 which is pressed against those surfaces by means of the pressing belts while the workpiece is advanced through the surface pressure-applying device. Foils 7 are pulled from supply rollers 8 to the surfaces of the workpiece. The pressing process can take place at room temperatures or higher temperatures to which the workpiece in subjected in the operation range. For producing desired pressure the upper frame as a whole can be pressed against the lower frame 2, or after a rough adjustment of the gap between the upper frame 3 and the lower frame 2, a required pressure is exerted on the surfaces of the moving workpiece by means of pressure air, the pressure of which is built up in pressure chambers 9 which are arranged respectively at the back sides of the present belts.

For a rough adjustment of the gap between the upper and lower frame sliding carriages 10 are provided, which are rigidly secured to the lower frame 2 and on which the upper frame 3 is displaceable in the vertical direction. This displacement is carried out by hydraulic cylinders 11. The pressure chambers 9 are limited at their sides, facing away from the respective pressing belts, by pressure plates 12 which can be moved relative to the respective frames 2 and 3 by means of hydraulic cylinders 13.

Figure 1:
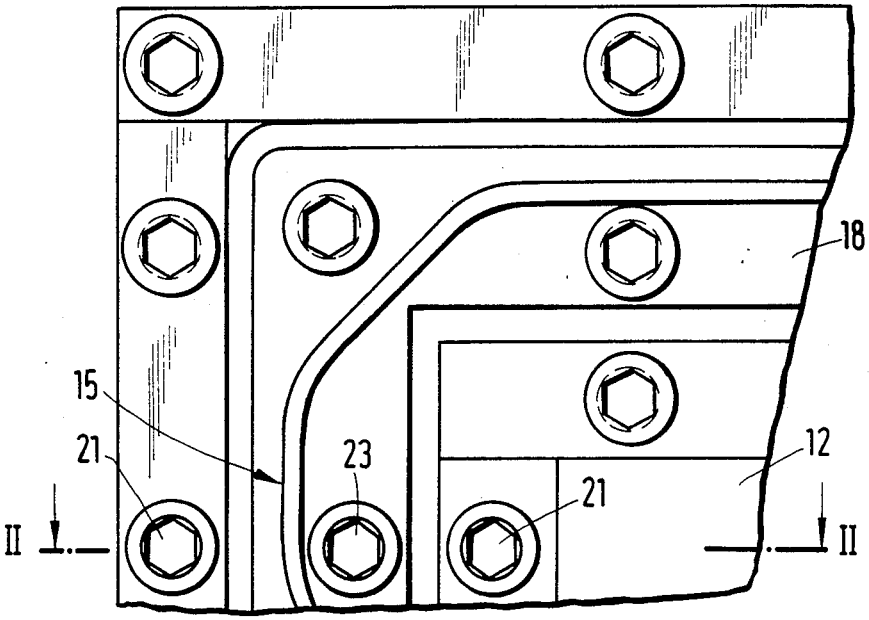
FIG. 1 is a bottom plan view of the corner-portion of the pressure plate of the device for applying surface pressure to an advancing workpiece.
Figure 2:
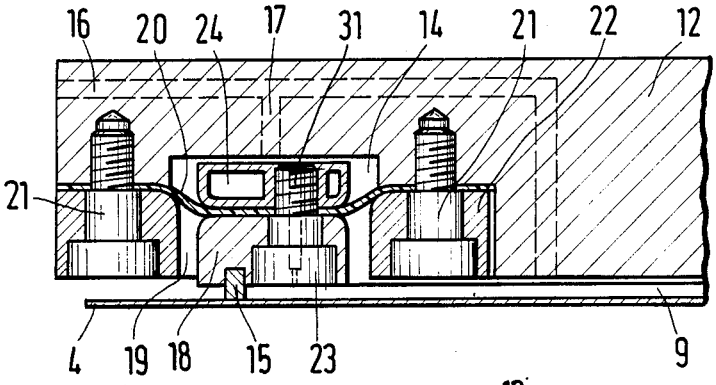
FIG. 2 is a sectional view taken along line II—II of FIG. 1.

Each pressure plate 12, shown in cross-section in FIG. 2, has at the side thereof, facing towards the pressing belt 4, a circular groove 14 which receives a sealing 15 as will be explained in detail herein below. In the assembled condition sealing 15 abuts against the pressing belt 4 which in operation rides against this sealing. Each pressure chamber 9 is thereby defined by the pressure plate 12, the working strand of the pressing belt 4 and the circular sealing 15. A passage 16 for admitting a pressure medium, for example pressure air, is provided in each pressure plate 12. Pressure medium is fed into each chamber 9 via passage 16 and its branch off portion 17.

The sealing 15 is a strip which is held in groove 14 by means of a support 18 which is shaped as a frame. Supporting frame 18 has at the bottom side thereof a circular groove open towards the pressing belt 4 and having a rectangular cross-section. Supporting frame 18 is arranged within groove 14 and is displaceable normally to the respective pressing belt 4 while sealing 15 is rigidly held in the supporting frame 18. The width of the supporting frame 18 is smaller than the width of groove 14 so that a space 19 is left between the wall of groove 14 and the mounting frame 18. The supporting frame is secured to a rubber-elastic sealing diaphragm 20 which is gas-tightly and fluid-tightly connected at its both longitudinal edges to the respective pressure plate 12.

The elastic diaphragm 20 is releasably connected to the pressure plate 12 by means of bolts 21 so that the edges of the diaphragm are clamped between holding strip-like members 22 and the pressure plate 12 by those bolts.

Bolts 23 extend through the supporting frame 18, which have threaded portions screwed into a hose 24 filled with the pressure medium. Hose 24 is mounted to the side of the diaphragm opposite to that facing the supporting frame 18.

It is of course understood that identical sealing arrangements are provided in both pressure plates 12.

Figure 4:
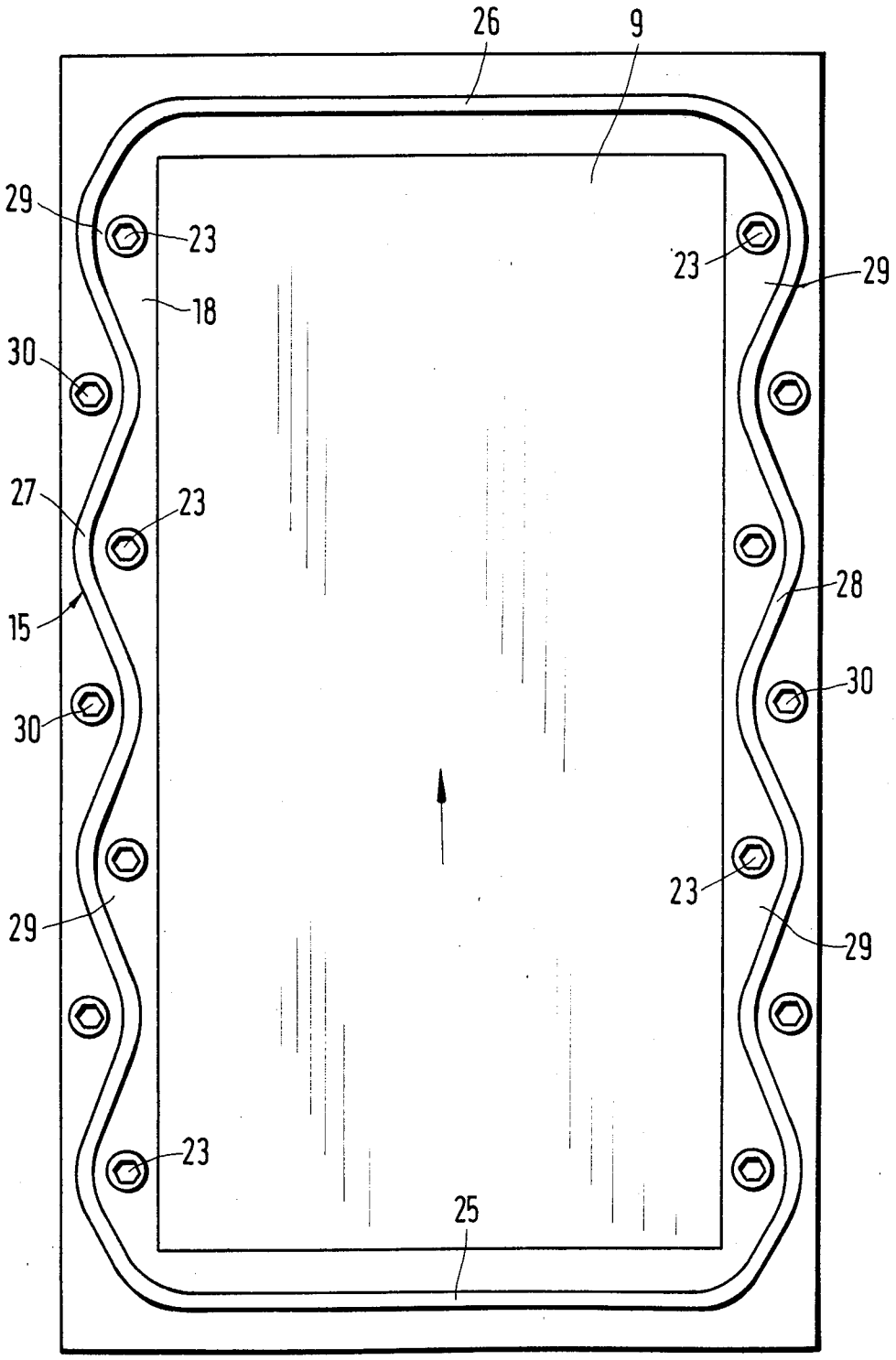
FIG. 4 is a plan view of the supporting frame in which a circular sealing is mounted.

In the embodiment illustrated in FIG. 4 the circular sealing 15 is combined of sealing strips 25 and 26 forming the transverse sealings and sealing strips 27 and 28 forming the longitudinal sealings.

Sealing strips 25 and 26 in the regions of the inlet and outlet of the pressing belt are straight-lined whereas sealing strips 27 and 28 are wave-shaped. Due to such a wave-shaped profiling each pressure chamber 9 has at its longitudinal sides convexities or bulging portions 29 which in the preferred embodiment are provided over the entire length of the sealing 15.

The admission and discharge of a lubrication agent, for example oil, into and out from the pressure chamber 9 is carried out in the proximity of sealing strips 27, 28.

There is a possibility that the upper portion of groove 14, limited by the diaphragm 20, be filled with oil, and this oil be loaded with pressure air. Bolts 23 in the region of the pressure chamber and/or bolts 30 outside the pressure chamber are provided with lubrication nozzles 31 through which the lubrication agent is fed to the pressing belt 4 so that the pressing belt transmits the lubrication agent to the sealing strip 15. The lubrication nozzles 31 have at the sides facing towards the pressure chamber 9 throttle bores which merge into the bores of greater diameter as seen from FIG. 2. These bores of greater diameter open into groove 14.

There is also a possibility that pressure air, which builts up a required pressure in each chamber 9, be admixed with oil particles so that oil mist would be applied to the sealing strips and to the working strands of the pressing belts 4.

Figure 5:
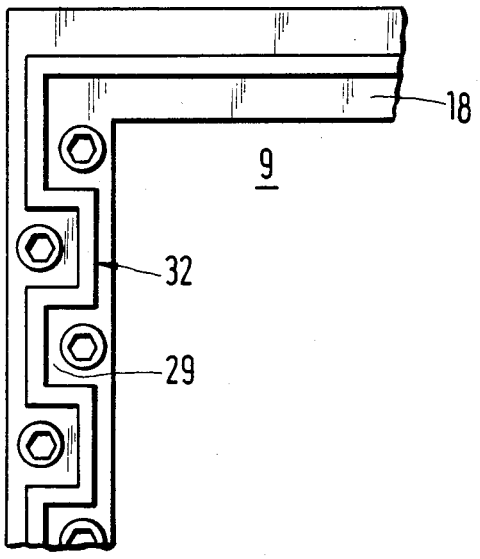
FIGS. 5 and 6 illustrate two modified embodiments of the sealing.
Figure 6:
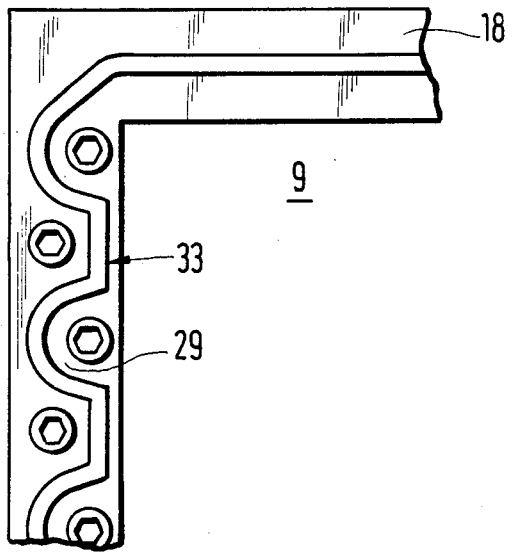

While in the embodiment illustrated in FIG. 4 sealing strips 27 and 28 are wave-shaped they can also be zig-zag-shaped or formed by circular segments as shown in FIGS. 5 and 6.

In the modification depicted in FIG. 5 sealing strips 32 corresponding to the lingitudinal edges of the pressure plate are shaped so that recesses or convexities 29 of the pressure chamber are rectangular at the longitudinal sides of the chamber.

In the embodiment of FIG. 6 sealing strips 33 are limited by recesses or convexities 29 of chamber 9, shaped as circular segments.

Longitudinal profiled strips 27, 28, 32, 33 extend approximately over the entire width of supporting frame 18.

Although sealing strips 25, 26 forming a transversal seal normal to the direction of elongation, are straight-line in FIG. 4 they can also be wave-shaped or zig-zag-shaped.

Sealing strips 25 can be provided outside chamber 9 and sealing strips 26 can be equipped inside chamber 9 with devices for feeding the lubrication agent into the chamber 9.

It will be understood that each of the elements described above, or two or more together, may also find a useful application in other types of devices for applying surface pressure to an advancing workpiece differing from the types described above.

While the invention has been illustrated and described as embodied in a device for applying surface pressure to an advancing workpiece, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for applying surface pressure to a workpiece being treated upon an advancement thereof through the device, comprising at least one endless pressing belt having a working strand which is pressed against the workpiece by means of a pressure medium; at least one pressure chamber containing the pressure medium; at least one rectangular pressure plate having longitudinal and transversed edges; and at least one sealing provided at the edges of said pressure plate and being supported against said pressing belt, said pressure chamber being defined by said working strand at a side thereof facing away from the workpiece, said pressure plate and said sealing, said sealing being an endless rectangular strip including longitudinal sealing portions extending in the longitudinal direction and transversal sealing portions extending in the transversal direction of said pressure plate, said longitudinal sealing portions being shaped so as to define alternating, shaped, outwardly extending portions of said pressure chamber, and wherein a lubrication agent is admitted into the pressure chamber at said outwardly extending portions of said pressure chamber.

2. The device as defined in claim 1, wherein the outwardly-extending portions of the pressure chamber are distributed over an entire length thereof.

3. The device as defined in claim 1, wherein said longitudinal sealing portions are wave-shaped.

4. The device as defined in claim 1, wherein said longitudinal sealing portions are zig-zag-shaped.

5. The device as defined in claim 1, wherein said outwardly-extending portions are rectangular.

6. The device as defined in claim 1, wherein said outwardly-extending portions are formed by circular segments.

7. The device as defined in claim 1, further including at least one supporting member for supporting said strip, the transversal sealing portions extending substantially over an entire width of said supporting member.

8. The device as defined in claim 7, further including at least one diaphragm connected to said supporting member, said diaphragm having edges which are fluid-tight and gas-tight connected to the pressure plate, said diaphragm with said pressure plate forming a chamber for admitting a pressure medium and a lubrication agent, said supporting member being provided with nozzles loaded with the pressure medium and the lubrication agent.

9. The device as defined in claim 8, further including fastening bolts for securing the supporting member to the diaphragm, said nozzles being arranged in said fastening bolts.

10. The device as defined in claim 1, wherein pressure air admixed with oil particles is used to build up pressure in said chamber.

11. The device as defined in claim 1, wherein the transversal sealing portions are wave-shaped.

12. The device as defined in claim 1, wherein the transversal sealing portions are zig-zag-shaped.

13. The device as defined in claim 1, further including means for feeding the lubrication agent, assigned to one of the transversal sealing portions outside said chamber and to another of said transversal sealing portions inside said pressure chamber.

* * * * *